United States Patent [19]

Franke

[11] 3,968,777

[45] July 13, 1976

[54] INTERNAL COMBUSTION ENGINE

[75] Inventor: Walter Franke, Maschen, u. Winsen-Luhe, Germany

[73] Assignee: Motoren Forschungs GmbH & Co. Kg Franken Motoren, Hamburg, Germany

[22] Filed: Apr. 17, 1975

[21] Appl. No.: 568,829

Related U.S. Application Data

[62] Division of Ser. No. 306,039, Nov. 13, 1972, Pat. No. 3,906,908.

[30] Foreign Application Priority Data

Nov. 15, 1971 Germany ..... 2156586

[52] U.S. Cl. ..... 123/44 R; 123/43 R; 123/44 D; 123/75 RC

[51] Int. Cl.[2] ..... F02B 57/00

[58] Field of Search ..... 123/44 R, 44 D, 43 R, 123/75 RC, 43 C, 44 E

[56] References Cited

UNITED STATES PATENTS

| | | | |
|---|---|---|---|
| 3,279,445 | 10/1966 | Karol | 123/44 D |
| 3,289,655 | 12/1966 | Franke | 123/44 D |
| 3,730,148 | 5/1973 | Bagby | 123/43 R |
| 3,735,741 | 5/1973 | Hatz | 123/43 R |
| 3,854,460 | 12/1974 | Raptis | 123/44 D |

FOREIGN PATENTS OR APPLICATIONS

| | | | |
|---|---|---|---|
| 1,451,742 | 11/1964 | Germany | 123/44 D |

*Primary Examiner*—Wendell E. Burns
*Attorney, Agent, or Firm*—Toren, McGeady and Stanger

[57] ABSTRACT

A cylinder has a head and a bottom. A piston is reciprocable in the cylinder and defines a power chamber with said head and an air compression chamber with said bottom. Controlled intake and exhaust ports are formed in said cylinder and adapted to communicate with said power chamber. Igniting means are operable to initiate a combustion of a fuel-air mixture in the power chamber. An inlet is formed in the cylinder and adapted to communicate with said compression chamber. A valve controls said inlet. The piston is adapted to perform in response to the combustion a power stroke toward a dead center near the bottom, whereby air is compressed in the compression chamber. Transfer means are provided to transfer compression air from said compression chamber to said exhaust port after said power stroke.

9 Claims, 9 Drawing Figures

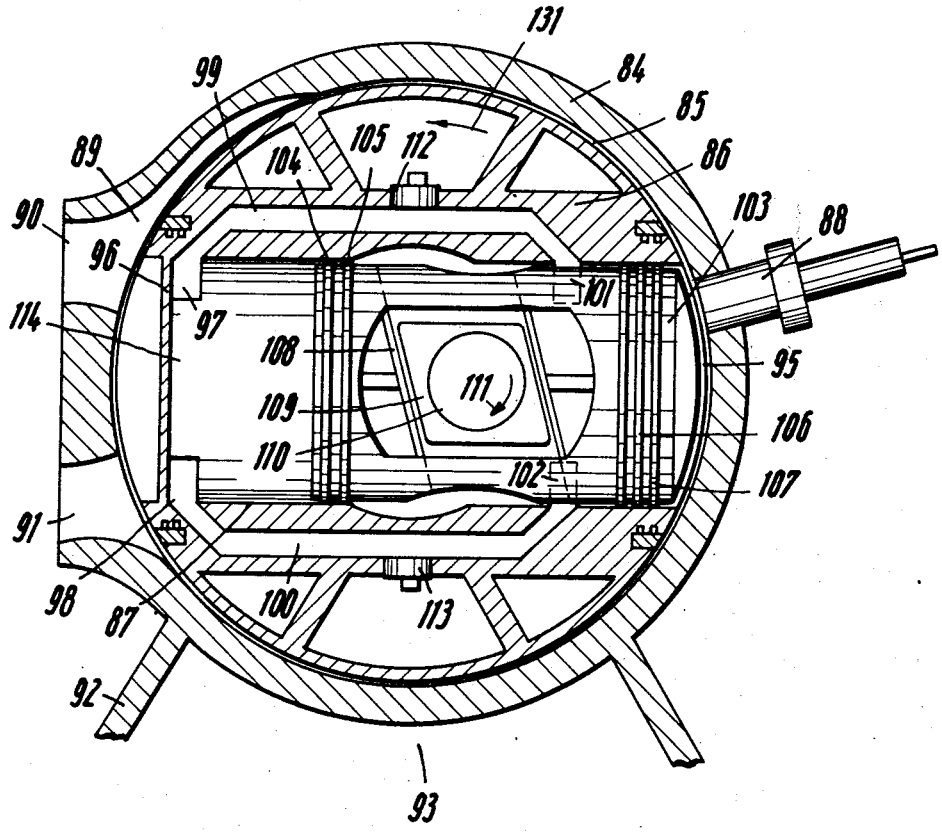

INTERNAL COMBUSTION ENGINE

This is a Division of application Ser. No. 306,039, filed Nov. 13, 1972 now U.S. Pat. No. 3,906,908.

SUMMARY OF THE INVENTION

This invention relates to an internal combustion engine, particularly a four-stroke cycle internal combustion engine, which comprises at least one cylinder, in which a piston is reciprocable and which cylinder comprises controlled intake and exhaust ports and an igniting device or a fuel injection nozzle, the piston being preferably rigidly connected to a piston rod. With regard to the provision of an igniting device, the invention relates to an Otto engine.

The statement that the piston is preferably rigidly connected to a piston rod suggests that the invention is applicable to other engines too, namely, to so-called rotary piston engines, such as are shown, e.g., in the French Pat. Specifications 1,321,071 or 798,519, in which, for instance, the cylinder assembly constitutes a rotor and is rotatably mounted in a housing, which is designed as a stator. In these engines, the piston may be formed with a slot, which extends substantially transversely to the piston, and which receives a pin that is rigid with the stator, or the piston or a piston assembly may be constrained, e.g., by a crankshaft, to move eccentrically relative to the cylinder assembly.

It is known to use a compressor in order to increase the power of internal combustion engines. These air compressors deliver compressed air into the intake duct or ducts before or after the carburetor. In such an arrangement, the increased compression is effected through the intake valve and for this reason is only of limited effect.

In connection with two-stroke cycle engines, it is known from the U.S. Pat. Specification No. 1,061,025 to seal the cylinder under the piston by a wall, which is provided with a sealed passage for the piston rod, and to establish a connection to the resulting chamber by a check valve which opens into this chamber, which is connected by a transfer duct to the power chamber of the cylinder. The mixture is compressed in the chamber under the piston before the piston can flow into the power chamber of the cylinder. The effect of this precompression is restricted to the precompression chamber, and a supercharging is not possible.

In that known design, a compressor is combined with a power piston of an internal combustion engine in a very compact arrangement.

That design which is known in connection with two-stroke cycle engines is based on the concept of feeding the power chamber or chambers of the engine entirely through the precompressor.

In four-stroke cycle Otto engines, it is known to effect a restricted increase in power by the provision of a compressor in an arrangement in which compressed air is delivered only to the intake duct so that in this arrangement the intake stroke of the piston effects an intake also of an enriched, compressed air.

The known arrangement has the disadvantage that the means for mounting and driving the compressor are independent of the cylinder-piston units of the engine. This fact involves a considerable space requirement and additional means. In rotary piston engines of the kind described hereinbefore it is not yet known to provide a compressor.

It is an object of the invention to provide an internal combustion Otto engine, particularly a four-stroke cycle engine, which is simple in structure and is not only capable of producing a higher power but more favorable in operation than known engines of this type particularly as regards afterburning while utilizing for this purpose inherently existing means, which are specially designed.

This object is accomplished according to the invention in that in a manner known per se the underside of the piston acts on a compression chamber which is defined by the cylinder and disposed over the bottom of the cylinder, the inlet disposed over the bottom of the cylinder is controlled by a valve, and compressed air from the compression chamber is supplied to the exhaust port after the power stroke, particularly for after burning. The compressed air may be conducted into the exhaust port through the power chamber or directly through a special conduit. It is surprising that purer exhaust gases are discharged in this case from an internal combustion engine which is provided with an igniting device.

In a preferred embodiment of an internal combustion engine in which the piston is connected to a piston rod, the outlet of the compression chamber of the piston, the transfer duct (26, 62-65, 99, 100) leading from the compressor is open after the power stroke, and compressed air is forced through the power chamber and through the exhaust port for the afterburning in the latter.

Another desirable feature resides in such an engine in that in a known manner the outlet of the compression chamber is connected to the power chamber of the cylinder by a transfer duct, which incorporates a valve, which connects to a branch duct leading to the exhaust duct, and said valve is controlled in such a manner, particularly by a camshaft, that the transfer duct is connected to the power chamber of the cylinder after the intake stroke and the branch duct is connected to the exhaust port after the power stroke. As a result, the power chamber of the cylinder is filled in normal manner with the mixture by the intake stroke and additional compressed air flows in when the power chamber has been filled. This affords the additional advantage that this compressed air when flowing in results in an internal cooling of the power chamber.

In rotary piston engines, to which the invention also relates, such valve is controlled by the stator in dependence on the setting of the camshaft, possibly also by means of the cylinder, which constitutes a rotor.

Because the branch duct is connected to the exhaust port, the afterburning is improved so that purer exhaust gases are discharged. In connection with this feature it is of special significance that a compression chamber is provided and is operated to synchronism with the at least one power piston and delivers to the power chamber of the cylinder and, to promote the discharge of purer exhaust gases, into the exhaust port. In this connection it is a feature of the invention that the transfer duct leading from the compression chamber is open after the power stroke and compressed air is forced through the power chamber to scavenge and cool the same and through the exhaust duct to promote the afterburning therein.

A particularly preferred embodiment of the invention constitutes a four-stroke cycle internal combustion engine, in which the cylinder at its end remote from the power chamber defined by the piston is sealed in known manner by a bottom, a piston rod extends preferably through a seal (this is particularly the case in engines having stationary cylinders), the cylinder chamber under the piston (this chamber will be referred to hereinafter also as a compression chamber) is connected to an intake pipe by a valve which is, e.g., positively controlled and consists preferably as a check valve, the cylinder is provided near its bottom with an opening, from which a transfer duct extends into the cylinder chamber over the piston, and an outlet opening of said transfer duct is disposed above the piston when the latter is at its lower dead center. This arrangement is particularly compact, and during the operation of this engine compression air can be delivered after the intake stroke of the power piston, as described hereinbefore, and compressed air is fed also after the power stroke of the piston because the compression chamber is effective during each power stroke of the piston so that compressed air is blown through the power chamber of the cylinder for scavenging and for afterburning. This has the advantage that the power chamber is scavenged faster and more effectively after the power stroke and that the afterburning is much improved. In this connection it must be taken into account that the valves, which are controlled particularly by a camshaft, are arranged so that the exhaust valve opens before the compressed air is fed when the piston has reached its lower dead center. In this case the piston may be used also as a sliding control valve. This will be particularly the case if the engine constitutes a so-called rotary piston engine. This feeding of the compressed air results also in an additional cooling, which is particularly desirable for the design and the life of the engine. The cooling affects also the exhaust valve and the spark plugs or the fuel injection nozzle.

The concept which has been disclosed results in an internal combustion engine which is very compact and virtually without need for additional means, only by a modification of inherently existing parts, results in a higher compression and a higher power, an improved afterburning and also in an improved cooling. The concept to use no controlled lift valves or sliding valves is applicable to special advantage in a rotary piston engine because complicated connections are eliminated in this case.

In a further special embodiment of such engine which comprises a plurality of cylinders, e.g., two cylinders and particularly four cylinders, it is an additional feature that each of the openings connecting the transfer ducts to the compression chambers is connected to another transfer duct which is associated with another piston in the same region, in a two-cylinder engine one cross-connecting duct is provided whereas in a four-cylinder engine two cross-connecting ducts are provided which differ in cross-section so that they have the same volume, and valve controls are provided so that compression chambers under two or more pistons are connected to the power chamber of each cylinder before the compression stroke and, in an engine having more than four cylinders, a larger number of correspondingly controlled cross-connecting ducts are provided. A transfer duct in a two-piston engine, which may consist of an in-line engine or an opposed-cylinder engine, will meet corresponding requirements.

According to a further feature of the invention, controlled valves are incorporated in the transfer ducts above the cross-connecting ducts and are operated, e.g., by means of a camshaft and speed-reducing transmissions, in such a manner that the above requirements are met.

In connection with a rotary piston engine, it is a feature of the invention that the cylinder which constitutes a rotor and contains two pistons, which are connected by a piston rod, which incorporates a cam slot member forming part of a Scotch yoke. These piston rods extend through cylinder bottoms, which are disposed at the cylinder ends disposed toward the center of the rotor, and the housing, which constitutes a stator, and the valve bushing is rotated in dependence on the power stroke in response to the rotation of the cylinder assembly to establish suitable connections. This is included in the scope of the invention.

This invention relates also to such an internal combustion engine which constitutes a rotary piston engine comprising at least one cylinder which rotates in a stator and in which a piston is reciprocable, the stator being provided at substantially opposite housing portions with an igniting device or fuel injection nozzle on one side and with intake and exhaust openings on the opposite side, which openings are controlled by the cylinder, which constitutes a rotor. In a preferred embodiment, the cylinder is closed at one end by a bottom and provided with at least one transfer duct, whiich is known per se and leads from the closed end to the open end of the cylinder in such a manner that the at least one transfer duct opens at such a distance from the open end of the cylinder that that piston exposes the opening of the transfer duct when the piston is disposed relative to the cylinder at its dead center near the closed cylinder end, this at least one transfer duct incorporates an intake valve, a transmission is connected between a crankshaft connected to at least one piston, and a shaft for rotating the at least one cylinder, which constitutes a rotor, and said transmission is designed so that the crankshaft has reached a position corresponding to a rotation through 270° when the cylinder constituting a rotor has rotated through 90°. This concept results in a rotary piston engine of the kind defined first hereinbefore, which is surprisingly simple and has a higher power because additional control means are not required in the preferred embodiment. In this case the valve consists of an intake valve so that an inwardly opening check valve is virtually provided, and the housing, which constitutes a stator, is sufficiently supplied with air to permit of an intake of air.

It is also included in the scope of the invention that the valve is a controlled valve, which in dependence on a crankshaft operatively connected to the piston is operable to connect the compression chamber over the closed end of the cylinder after the power stroke therein to the power chamber of another cylinder. This may result in increased power. In such an arrangement, a speed-reducing transmission having a transmission ratio of 1:3 is desirably provided so that the rotor assembly rotates at a lower peripheral speed than the crankshaft. This arrangement results in a rotary piston engine which is structurally simple and is smooth in operation and has no complicated control means.

It is also within the scope of the invention to provide a reversing transmission having a transmission ratio of 1:1.

In a cylindrical guide opening formed in the stator housing, the exhaust opening begins suitably about 90° behind the igniting device or fuel injection nozzle in the direction of rotation of the cylinder.

BRIEF DESCRIPTION OF THE DRAWINGS

The invention will be explained hereinafter with reference to embodiments shown by way of example on the drawings, in which

FIG. 2 is a diagrammatic vertical longitudinal sectional view showing a four-stroke cycle, four-cylinder, in-line engine.

DETAILED DESCRIPTION OF THE INVENTION

All Figures show only those parts which are functionally required for an understanding of the invention.

It is known that in a four-stroke cycle engine an intake stroke of the piston in one direction is succeeded by a compression stroke in the opposite direction, whereafter the ignition is effected, which is succeeded by a power stroke and finally by an exhaust stroke. These strokes are functionally assisted by lift valves or sliding valves, which are properly controlled and consist of inlet and outlet valves, which are controlled by a camshaft, which is driven in dependence on the rotation of the crankshaft to which the piston is also operatively connected. The valves may be mounted in the cylinder head or as sliding valves in the side walls of the cylinder near the cylinder head. In dependence on the power stroke, an igniting device or a fuel injection nozzle is controlled, which becomes effective after the compression stroke. This is known, and the invention is applicable to engines regardless of the manner in which this function is controlled. It is essential, however, that there is a functional dependence between the parts, i.e., between the rotation of the crankshaft and of the camshaft.

Figure 1:
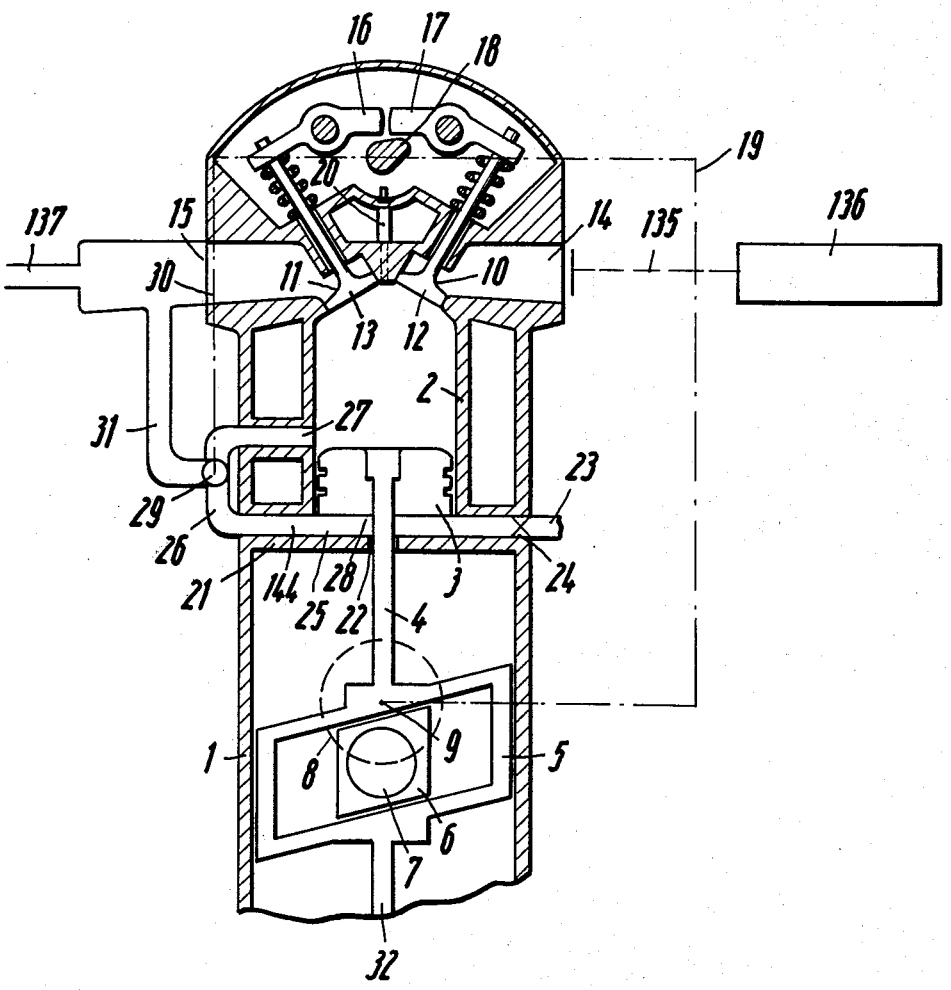
FIG. 1 is a diagrammatic sectional view showing a piston-cylinder engine assembly and illustrates the invention only as applied to one engine cylinder unit, the section being taken, for instance, on line I—I in FIG. 2 although this is stated only to indicate the section plane in an engine because
Figure 2:
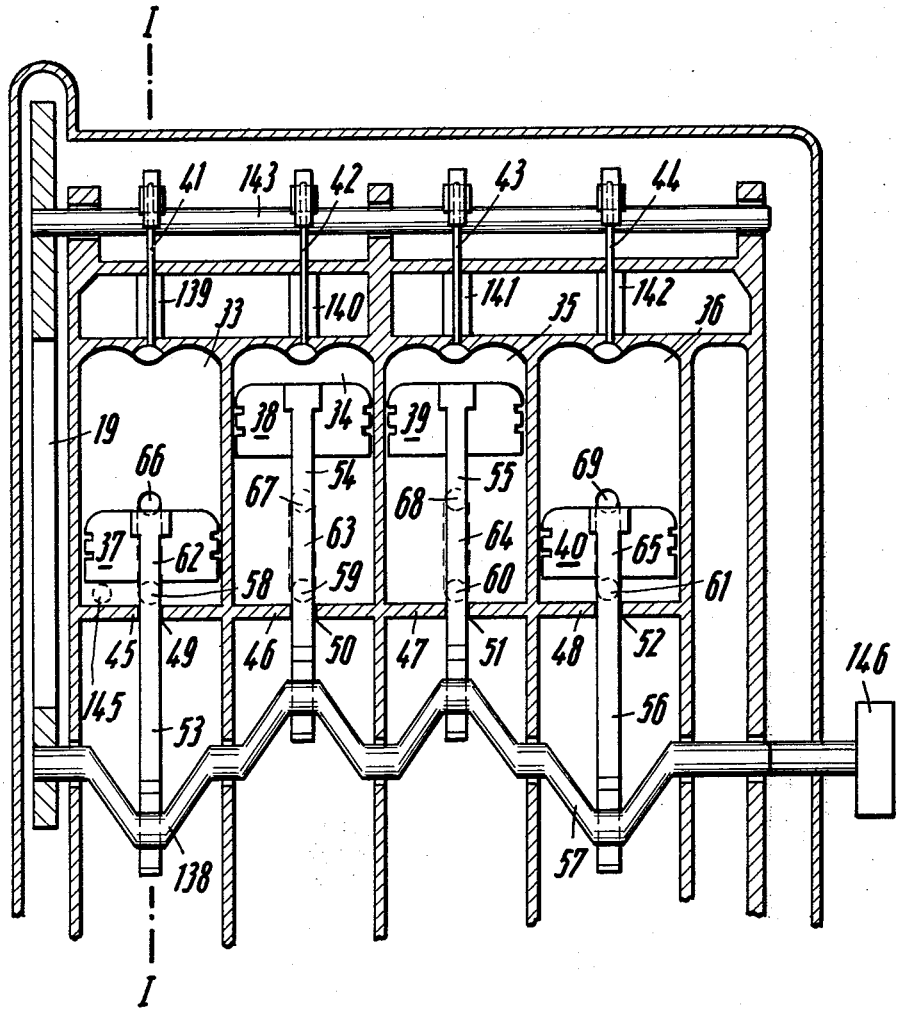
FIG. 2 illustrates further modifications.

FIG. 1 shows part of an opposed-cylinder engine. A crankshaft housing 1 contains two cylinders, one of which is shown at 2. A piston 3 is reciprocable in the cylinder 2. The piston is rigidly connected to a piston rod 4, which is terminated by a member 5 having a cam slot, which extends preferably at an oblique angle to the axis of the piston. A crankpin 7 of a crank is rotatably mounted in a sliding block 6, which is guided in the cam slot of the member 5. This crank rotates about the axis 9 around a dotted-line circle 8. The oblique orientation of the cam slot member has the advantage that the piston can move more easily through its dead centers. FIG. 2 shows a crankshaft 57 and a crankpin 138, which corresponds to the crankpin 7.

The cylinder 2 is formed in its cylinder head with two openings 10, 11, each of which contains a camshaft-controlled valve, namely, an intake valve 12 communicating with an intake port 14 and an exhaust valve 13 communicating with an exhaust port 15. The intake port 14 communicates in the usual manner through a conduit 135 with the unit 136, which comprises a carburetor and a fuel tank. The exhaust port 15 terminates in a so-called exhaust pipe 137. The valves may be controlled in known manner by rocker levers 16, 17 and a camshaft 18, which is connected by a transmission 19 to the crankshaft 9. Such transmission is shown with the same reference characters in FIG. 2. It is also understood that the cylinder head contains the igniting device 20, which is operated by a distributor, known per se, when a predetermined time has elapsed after the compression.

In this embodiment, the cylinder 2 at that end which is remote from the cylinder head provided with the valve-controlled ports is sealed by a partition 21 from the crankshaft housing 1. The partition 21 contains a sealed passage 22, which is defined, e.g., by a stuffing-box and through which the piston rod 4 extends. The piston rod moves along a straight line because it is connected to a Scotch yoke. The latter could be replaced by an eccentric.

The chamber under the piston 3 is connected to an intake port 23, which contains a check valve 24 or other means for positively controlling the intake. The check valve 24 or equivalent means opens to the interior of the cylinder 2. This cylinder chamber 28 may be described as a compression chamber and is provided above the partition 21 with an opening 25, which communicates with a transfer duct 26, which leads to an opening 27, which communicates with the power chamber of the cylinder 2 and is disposed at a point which is above the piston 3 when the latter is at its lower dead center.

In this embodiment it is apparent particularly in the illustrated position that when the opening 27 has been exposed the compressed air is transferred from the chamber 28 under the piston through the transfer duct 26 into the power chamber. This transfer is desired whenever the piston 3 has performed an intake stroke. For this purpose, the valves 12, 13 are synchronously controlled in known manner.

If there is only the transfer duct, compressed air will be fed also after the power stroke of the piston, i.e., when the exhaust valve 13 is open in the position shown. In that case, the compressed air which is transferred scavenges the power chamber of the cylinder so that the walls and the exhaust valve are cooled, and air is fed into the exhaust port 15 so that an afterburning can be effected therein.

FIG. 1 shows an alternative arrangement, in which the transfer duct 26 incorporates a control valve 29. The latter is connected to the camshaft 13 by a linkage 30, which may incorporate a speed-reducing transmission. The control valve 29 is succeeded by a branch duct 31, which leads into the exhaust port 15. The control valve 29 may be a check valve preventing reverse flow from the branch duct 31 to the transfer duct 26. In that arrangement, the linkage 30 and the means comprised therein are so designed that the transfer duct 26 between the openings 25 and 27 is open after an intake stroke so that compressed air is then transferred into the power chamber of the cylinder whereas after a power stroke of the piston 3 the control valve 29 has been shifted to establish a connection to the branch duct 31 so that compressed air is fed into the exhaust port 15. During the succeeding exhaust stroke, an afterburning in the exhaust port 15 is thus ensured by the added air.

FIG. 1 illustrates a basic concept. The cam slot member 5 is also connected to another piston rod 32, which is associated with a cylinder-piston unit that is similar to the one described hereinbefore. It will be understood that the branch duct 31 may alternatively communicate with a transfer duct of that second unit and be controlled by the valves which are incorporated in the transfer ducts and one of which is designated 29. The control is such in this case that the air which has been compressed under the piston 3 is fed into the cylinder after each stroke performed by a piston in the direction toward the crankshaft 7. This arrangement will result in a further increase of the power which is produced and, if the air is fed after the power stroke, in an improved afterburning.

In accordance with this concept, the compressed volumes under the two pistons may be transfered into the cylinder chambers after the power stroke so that both the cooling action and the scavenging action are much increased.

FIG. 2 shows diagrammatically four cylinders 33, 34, 35, 36 of an in-line engine. The lead lines of the reference characters terminate in the cylinder chambers. The associated pistons are designated 37 to 40. The cylinder heads incorporate valve assemblies 41 to 44 and are provided with igniting devices 139 to 142. The valve assemblies 41 to 44 may be designed like the valves 12, 13 in FIG. 1 so that each valve assembly comprises two valves, which are disposed one behind the other in the view shown in FIG. 2 and properly controlled by a camshaft 143, which is driven by the transmission 19. The cylinders 33 to 36 are closed under the pistons by partitions 45 to 48, which are provided with sealed passages 49 to 52 for piston rods 53 to 56, which are connected in known manner to a crankshaft 57. For instance, the piston rods rigidly connected to the pistons 37 to 40 may be connected to cranks, e.g., 138, of the crankshaft 57, in known manner by means of eccentric discs or preferably by means of a cam slot member such as is designated 5 in FIG. 1 and in its cam slot guides a sliding block 6. The crankshaft 57 drives the transmission 19, which is connected to the camshaft 143. The crankshaft 57 extends out of the cylinder block and carries an output element 146 consisting of a clutch, a gear or the like. It will be understood that openings 58 to 61 are provided as described above the partitions and communicate with transfer ducts 62 to 65, which extend parallel to the cylinders and communicate through upper openings 66 to 69 with the power chambers of the cylinders when the pistons are at their lower dead centers. Such transfer duct, such as 62 with the openings 58, 66, corresponds to the transfer duct 26 in FIG. 1 with its openings, the upper one of which is designated, e.g., 27. The lower opening is designated 144 in FIG. 1. In FIG. 2 an intake port corresponding to the intake port 23 with check valve 24 in FIG. 1 opens on the level of the lower openings 58 to 61. Such intake port is provided, e.g., at 145 under the piston 37 in FIG. 2.

In FIG. 2, both ends of the transfer ducts 62 to 65 are exposed when the piston is at its lower dead center. Hence, in the engine shown in FIG. 2 compressed air is transferred into the power chamber of each cylinder after an intake stroke and after a power stroke of the associated piston. This arrangement has the advantage that the results described hereinbefore are produced with means which are simple and rugged and do not require maintenance and without need for separate valves because the power pistons 37 to 40 act also as sliding control valves.

Figure 3:
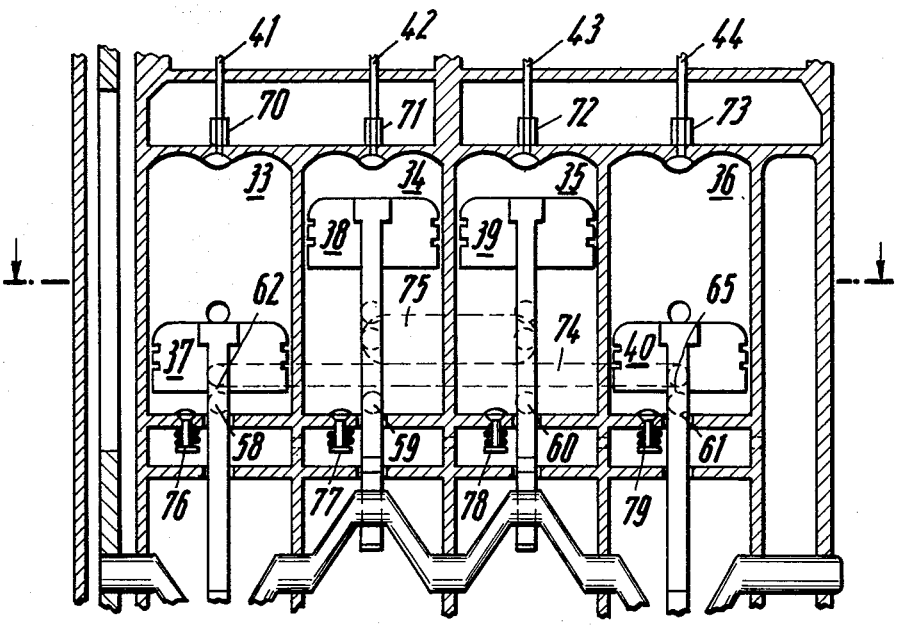
FIG. 3 is a diagrammatic side elevation showing a modified embodiment of a four-stroke cycle, four-cylinder, in-line engine.
Figure 4:
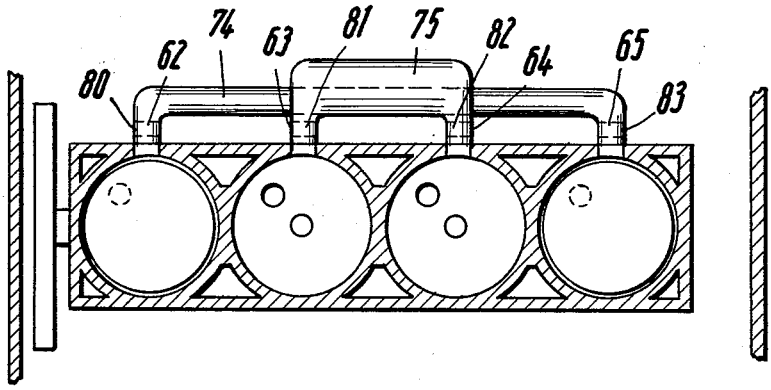
FIG. 4 is a diagrammatic sectional view taken on line IV—IV in FIG. 3.

FIGS. 3 and 4 show an arrangement which is similar to that in FIG. 2 in the same operating position so that like parts are designated with like reference characters. FIG. 3 shows the engine in the same operating position as in FIG. 2. For instance, the piston 37 has performed an intake stroke, the piston 40 has performed a power stroke, the piston 38 has performed an exhaust stroke and the piston 39 a compression stroke. The valve assemblies 41 to 44 consisting each of an intake valve and an exhaust valve, and the diagrammatically controlled igniting devices or fuel-injection nozzles 70 to 73, are properly controlled. The air compression chambers under the pistons 37 to 40 are interconnected by cross-connection ducts 74, 75, which open into the respective transfer ducts 62 to 65. For instance, the cross-connection duct 74 is connected between the transfer ducts 62 and 65 of the outer cylinders 33, 36, and the cross-connection duct 75 is connected between the transfer ducts 63, 64 of the intermediate cylinders 34, 35. It is apparent that all air compression chambers are connected to check valves 76 to 79, which are of known type and open into the compression chambers, with which the openings 58 to 61 communicate too.

These check valves are shown only by way of example and may be replaced by positively controlled valves, which may be controlled, e.g., by the camshaft.

In the embodiment shown by way of example, two cross-connecting ducts 74, 75 are provided. It will be understood that in a two-cylinder engine it will be sufficient to provide only one of the cross-connecting ducts 74 and 75 with suitable control means. For this reason, the invention is not limited to four-cylinder engines. It will also be understood that more cross-connecting ducts may be provided if the engine comprises more cylinders, which in the embodiment shown will be added in pairs of cylinders provided with respective pistons.

The cross-connecting ducts 74, 75 are designed to have equal volumes. This is required for a uniform operation of the engine. For this reason, the cross-connecting duct 75 has between its connections a larger cross-section than the cross-connecting duct 74. The difference in cross-section will depend on the ratio of the lengths of the two ducts.

It is also apparent from FIG. 3 that the cross-connecting ducts 74, 75 extend on different levels. The openings 58 to 61 are directly adjoined by portions of the transfer ducts 62 to 65. These portions, which extend as far as to the opening of the respective cross-connecting duct 74 or 75, incorporate controlled valves 80 to 83, which are required in this embodiment if air which has been compressed in the compression chambers under, e.g., two pistons is forced into a cylinder chamber before the compression stroke or preferably before the exhaust stroke. For instance, the piston 37 is about to begin its compression stroke so that the valve 62 is open and compressed air is supplied from the compression chamber under the piston 37 and through the cross-connecting duct 74 from the chamber under the piston 40. In this case the valve 83 is closed to prevent a supply of compressed air into the chamber of cylinder 36. An inverted control is effected between other cylinder chambers. If in this embodiment the supply of compressed air serves only to increase the power, this can be accomplished with a minimum number of additional elements. It will also be apparent that the afterburning can be improved by a suitable additional valve assembly as shown in FIG. 1 if air which has been compressed under the cylinders 37 to 40 is discharged into the exhaust ports, for instance, through the cylinders. This control to improve the afterburning is highly significant. In this connection it may be pointed out that the valves 80 to 83 may be controlled by being operatively connected to the camshaft 143 by means which correspond to the linkage 30 shown in FIG. 1 in connection with the valve 29. Depending on the nature of the desired control, this linkage may incorporate transmissions.

Although the invention has been explained hereinbefore with reference to in-line engines having cylinders which cooperate with a crankshaft, it will be understood that the nature of the invention resides in the special production of compressed air below the power piston of a four-stroke cycle engine. The air supply ducts according to the invention may also be provided in a rotary piston engine which has a rotatably cylinder in which a piston reciprocates, which defines at one end a power chamber and at the other end an air compression chamber. An embodiment of such rotary piston engine is shown in FIGS. 5 to 9 by way of example. This embodiment is preferred because the teaching of the invention can be embodied therein without need for appreciable complicated control means.

The engine comprises a housing 84, which constitutes a stator and is provided on its inside in a substantial part of its length with a cylindrical bearing surface 85 for a rotor 86, which comprises the cylinder assembly. In FIGS. 5 to 8, a cylinder 87 is shown in section in different operating positions of the engine. The stator housing 84 is provided with a fuel injection nozzle 88 and, if desired, with an igniting device. The housing is also provided with an exhaust slot 89, which communicates with an exhaust port 90. In the direction of rotation indicated by the arrow 131, the intake port 91 succeeds the exhaust slot by such an angle that the trailing edge of the exhaust slot, considered in the direction of rotation, will still be exposed to the cylinder chamber when the inlet port begins to be exposed to said cylinder chamber.

The housing is mounted on a base 92, which contains an oil pan 93, which is not shown more fully.

Figure 5:
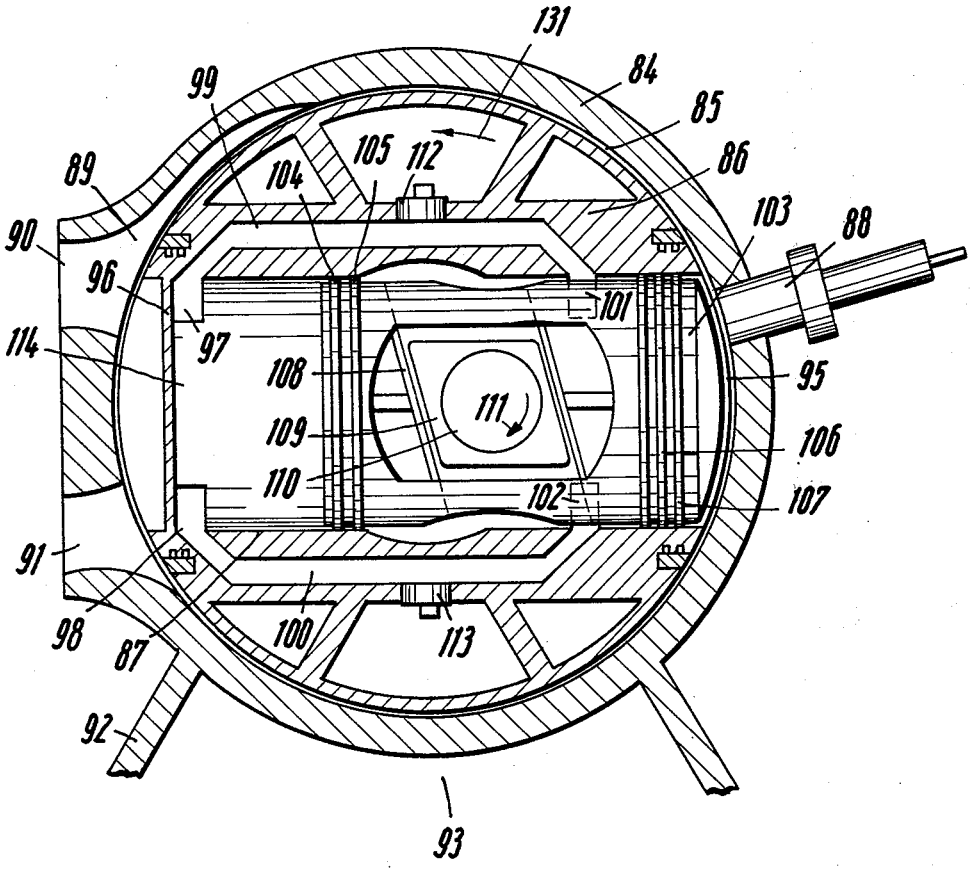
FIGS. 5 to 8 are vertical transverse sectional views illustrating the mode of operation of a rotary-piston engine embodying the invention.
Figure 6:
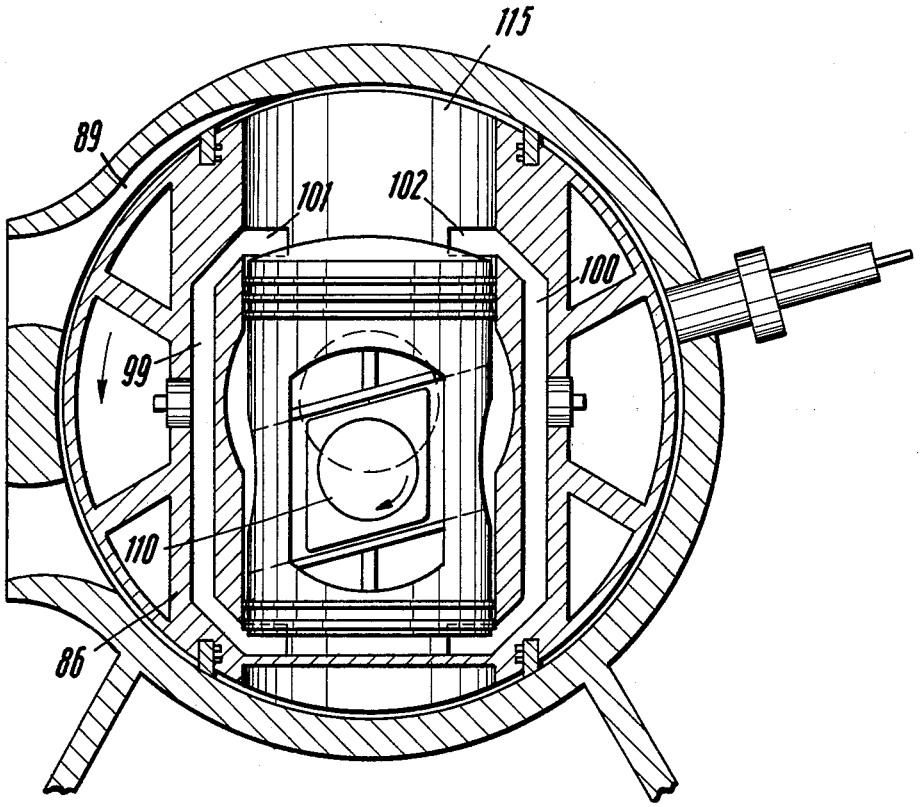

The rotor 36 is guided on the cylindrical bearing surface and comprises the cylinder assembly, of which only the cylinder 87 is shown in FIGS. 5 to 8. The cylinder 87 has an internal liner and is open at one end at 95 and closed at the other end by a bottom 96. For instance, two openings 97, 98 communicating with transfer ducts 99, 100 are provided in the cylinder above the bottom. The other openings 101, 102 of the transfer ducts 99, 100 are provided in the cylinder on such a level that, as shown in FIG. 6, these openings are exposed when the piston 103 moving in said cylinder is at that dead center position in which it is nearer to the bottom 96. The piston 103 is sealed and guided in the cylinder 87 by piston rings 104, 105, 106, 107. In its intermediate portion, the piston is provided internally with a cam slot 108, in which a sliding block 109 is guided, in which the pin 110 of a crank is rotatably mounted. The direction of rotation of the crank is indicated by the arrow 111 and is opposite to the direction of rotation 131 of the rotor 86. The parts moving in opposite senses have the same speed.

It is pointed out at this juncture that in the simple embodiment which is shown the overflow ducts 99, 100 contain intake valves 112, 113, which consist, e.g., of inwardly opening check valves.

FIG. 5 shows the position at the time of ignition. When the crankpin 110 has then rotated through 90° in the sense of the arrow 111 and the rotor 86 has also rotated through 90° in the sense of the arrow 131, the position shown in FIG. 6 has been reached. During the change to this position, the contents of the compression chamber 114 over the bottom 96 has been compressed when the piston was driven in its working stroke to the position shown in FIG. 6. FIG. 6 shows the piston at its lower dead center, in which the openings 101, 102 of the transfer ducts 99, 100 are exposed so that compressed air flows through the transfer ducts into the power chamber 115 to scavenge the same. At this time, the open end of the cylinder communicates already with the exhaust slot 89.

Figure 7:
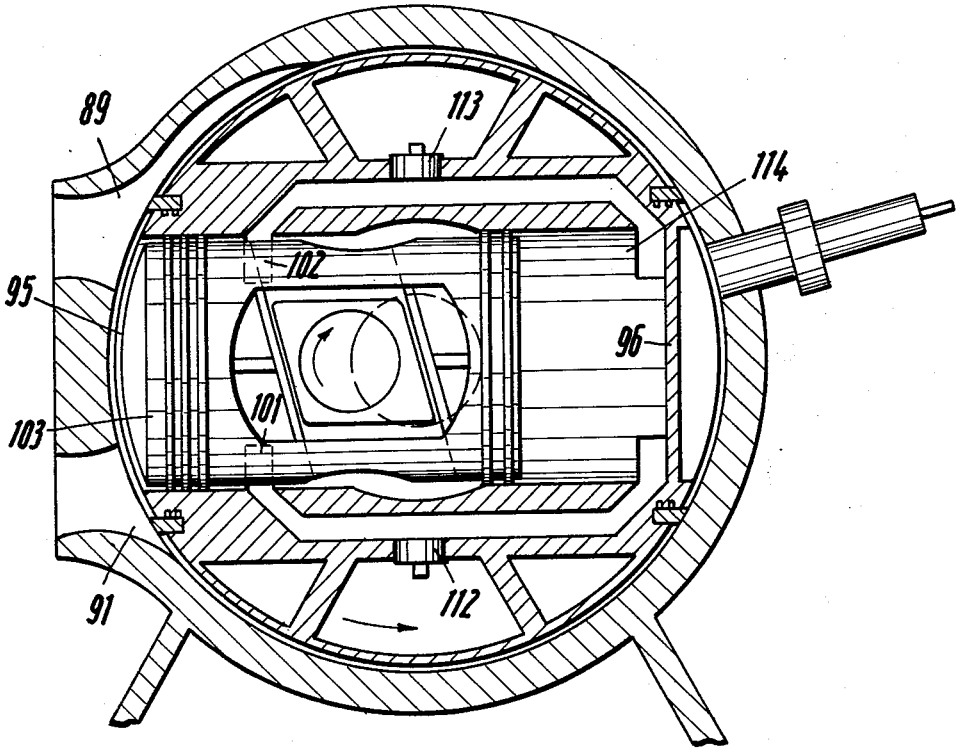

When the crankpin 110 and the rotor 86 have been rotated through further 90° in the indicated directions, the position shown in FIG. 7 is reached. The piston is now in the position which is otherwise described as the upper dead center position, in which the piston occupies the power chamber and the open end 95 of the cylinder communicates with the exhaust slot 89 and also with the intake port 91. In this position of the piston, the compression chamber over the bottom 96 has a large volume and has been filled through the intake valves 112, 113. In this position the piston closes the openings 101 and 102, which are close to the power chamber.

Figure 8:
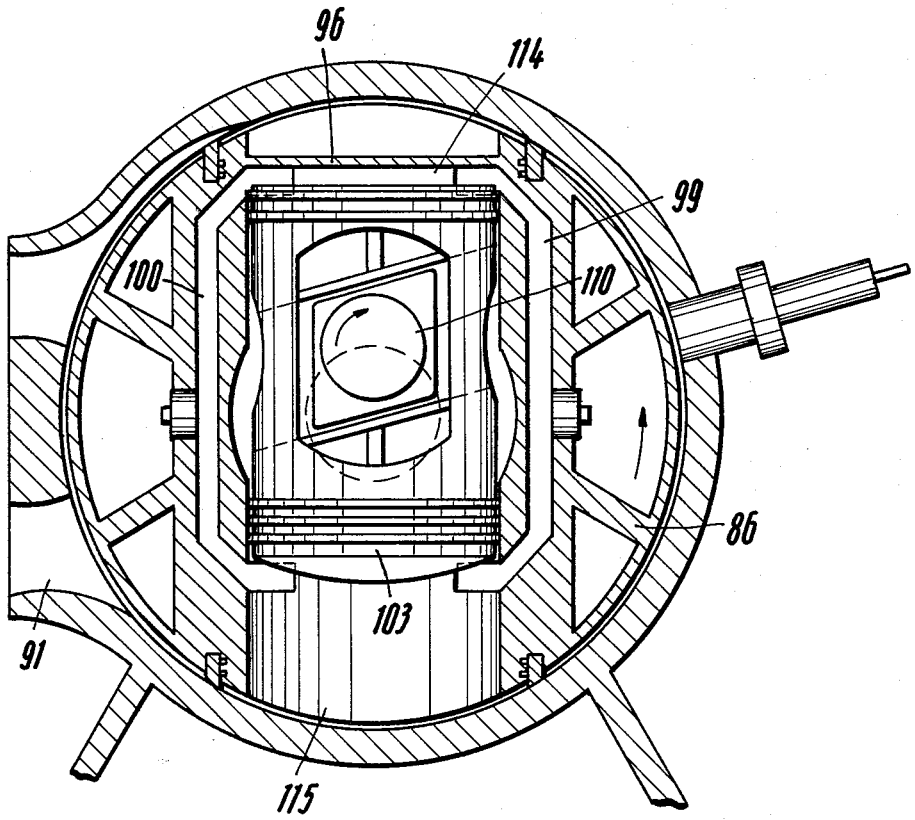

FIG. 8 shows the operating position which is reached when both the crankpin 110 and the rotor 86 have been rotated through further 90°. When moving past the intake port 91, the power chamber 115 has been filled during the intake stroke of the piston whereas the volume of the compression chamber 114 has been compressed. When the piston 103 after its suction stroke is at its dead center position shown in FIG. 8, compressed air flows through the transfer passages 99, 100 into the power chamber 115 so that the same is supercharged as described hereinbefore. It will be apparent that the intake port and exhaust slot are now closed because the compression chamber 114 is closed by the bottom 96.

After a further rotation of the parts through 90° in the indicated directions of rotation, the position shown in FIG. 5 has been resumed, in which the power stroke is initiated whereas the compression chamber 114 has been filled because the piston has performed a suction stroke with respect to said compression chamber.

It is thus shown that the mere provision of the transfer ducts 99, 100 results in an increase of the power or a rotary piston engine whereas further changes are not required.

Figure 9:
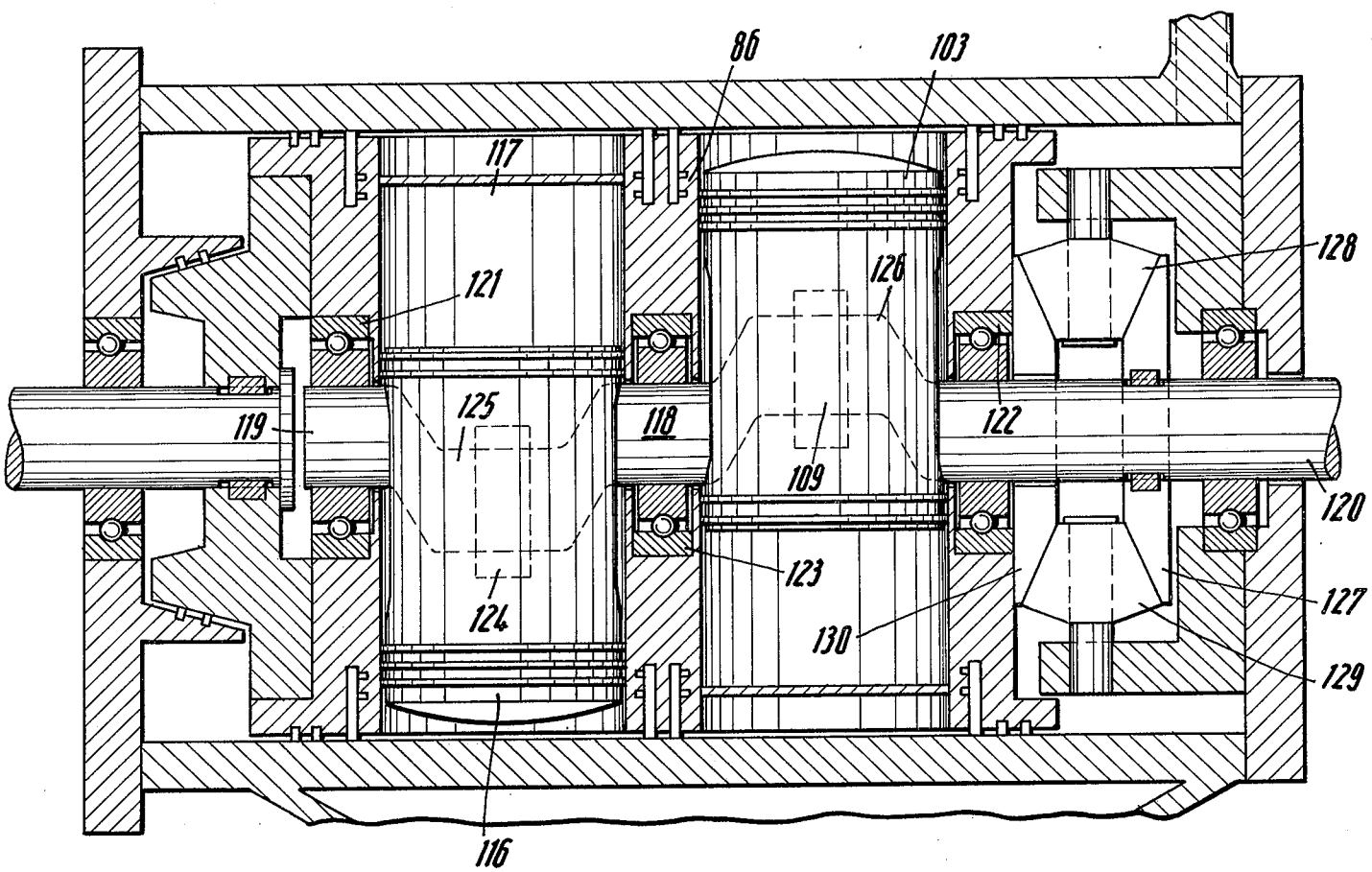
FIG. 9 is a sectional view taken on line IX—IX in FIG. 6 and illustrates the arrangement of a plurality of pistons in such engine.

FIG. 9 shows a piston 103. It is apparent that another piston 116, which is parallel to the piston 103, is guided in the cylinder 117 and moves in phase opposition to the piston 103. The two pistons are operatively connected by Scotch yokes to a crankshaft 118, whose ends 119, 120 are rotatably mounted in the rotor 86 by means of centrally disposed bearings 121, 122, 123. The pistons 103, 117 are each connected to a cam slot member such as 108, and the offset crankpins 125, 126 extend through sliding blocks 109, 124, which are guided in said cam slot members.

The crankshaft carries at its end a bevel gear 127, which is in mesh with, for instance, three planet pinions 128, 129 mounted in the stator. These planet pinions mesh also with an internal bevel gear 130, which is secured to the rotor assembly comprising the cylinders. In this way it is ensured that the crankshaft and rotor rotate in opposite senses.

The description given hereinbefore has referred only to the essential parts of a particularly desirable embodiment whereas individual parts, such as cooling means, sealing means etc. are partly shown but are not described.

What is claimed is:

1. An internal combustion engine which comprises a stator defining a circular cylindrical opening and having substantially diametrically oppositely disposed, first and second portions adjoining said opening, said stator being provided in said first portion with combustion-initiating means communicating with said opening and in said second portion with an intake port and an exhaust port communicating with said opening, at least one cylinder diametrically extending in and rotatably mounted in said opening and adapted to control said combustion-initiating means and said intake and exhaust ports and having an open end and a bottom closing said cylinder at its opposite end, a piston which is reciprocable in said cylinder and defines a power chamber with said open end and an air compression chamber with said bottom, said piston being adapted to move between a first dead center near said bottom and a second dead center opposite to said bottom, said combustion-initiating means being adapted to initiate the combustion of a fuel-air mixture in said power chamber, a transfer duct formed in said cylinder and adapted to connect said compression chamber to said power chamber when said piston is at said first dead center, an inlet valve connected to said transfer duct, a crankshaft operatively connected to said piston, a rotatable drive shaft connected to said cylinder and adapted to rotate the same, and torque-transmitting means arranged to rotate said drive shaft from a given position to a subsequent position which is angularly spaced 90° therefrom in response to a rotation of said crankshaft from a given position to a position which is spaced 90° therefrom in a sense which is opposite to the sense in which said subsequent position of said drive shaft is spaced 90° apart from said given position thereof.

2. An internal combustion engine as set forth in claim 1, in which said torque-transmitting means constitute a speed-reducing transmission having a transmission ratio of 1:3.

3. An internal combustion engine as set forth in claim 1, in which said torque-transmitting means constitute a reversing transmission having a transmission ratio of 1:1.

4. An internal combustion engine as set forth in claim 1, in which said inlet valve is arranged to open in response to a vacuum in said compression chamber.

5. An internal combustion engine as set forth in claim 1, in which said stator has substantially diametrically oppositely disposed third and fourth portions adjoining said opening, said stator is provided in said third portion with second combustion-initiating means communicating with said opening and in said fourth portion with a second intake port and with a second exhaust port communicating with said opening, a second cylinder extends diametrically in and is rotatably mounted in said opening and connected to said first-mentioned cylinder for joint rotation and adapted to control said second combustion-initiating means and said intake and exhaust ports and has an open end and a bottom closing said second cylinder at its opposite end, a second piston is operatively connected to said crankshaft and reciprocable in said second cylinder in phase opposition to said first-mentioned piston between a first dead center near said bottom of said second cylinder and a second dead center opposite to said bottom of said second cylinder and defines a second power chamber with said open end of said second cylinder and a second air compression chamber with said bottom of said second cylinder, said second combustion-initiating means is adapted to initiate the combustion of a fuel air mixture in said second power chamber, a second transfer duct is formed in said second cylinder and adapted to connect said second compression chamber to said second power chamber when said second piston is at said first dead center, a second inlet valve is connected to said second transfer duct, each of said pistons is adapted to perform a power stroke toward said first dead center, means are provided which connect said first-mentioned inlet valve to said second power chamber and connect said second inlet valve to said first power chamber and means are provided which are operatively connected to said crankshaft and arranged to open said first-mentioned inlet valve after said power stroke of said first-mentioned piston and to open said second inlet valve after said power stroke of said second piston for a transfer of compressed air from the compression chamber of a cylinder in which the piston has just completed a power stroke to the power chamber of the other cylinder.

6. An internal combustion engine as set forth in claim 1, in which said cylinder is arranged to rotate in said opening in a predetermined sense and said exhaust port succeeds said combustion-initiating means and is spaced about 90° therefrom in said sense of rotation.

7. An internal combustion engine as set forth in claim 1, in which said open end of said cylinder is adapted to communicate with said intake and exhaust ports at the same time.

8. An internal combustion engine as set forth in claim 1, in which said combustion-initiating means comprise igniting means.

9. An internal combustion engine as set forth in claim 1, in which said combustion-initiating means comprise a fuel injection nozzle.

* * * * *